US009963868B2

(12) United States Patent
Gutu

(10) Patent No.: US 9,963,868 B2
(45) Date of Patent: May 8, 2018

(54) DRAIN FIELD ALARM

(71) Applicant: Mircea Gutu, Lafayette, NJ (US)

(72) Inventor: Mircea Gutu, Lafayette, NJ (US)

( * ) Notice: Subject to any disclaimer, the term of this patent is extended or adjusted under 35 U.S.C. 154(b) by 45 days.

(21) Appl. No.: 15/252,248

(22) Filed: Aug. 31, 2016

(65) Prior Publication Data

US 2018/0058058 A1 Mar. 1, 2018

(51) Int. Cl.

| | |
|---|---|
| ***G08B 21/00*** | (2006.01) |
| ***E03F 7/00*** | (2006.01) |
| ***G08B 21/18*** | (2006.01) |
| *E03F 1/00* | (2006.01) |

(52) U.S. Cl.

CPC ..... *E03F 7/00* (2013.01); *G08B 21/18* (2013.01); *E03F 1/002* (2013.01); *E03F 2201/40* (2013.01)

(58) Field of Classification Search

None

See application file for complete search history.

(56) References Cited

U.S. PATENT DOCUMENTS 3,954,612 A * 5/1976 Wilkerson ..... G01F 23/58 116/228
5,352,444 A * 10/1994 Cox ..... A61L 9/01 424/617
6,177,004 B1 * 1/2001 Bracone, Jr. ..... B01D 17/00 210/151
6,440,307 B1 * 8/2002 Philip ..... C02F 9/005 210/263
6,790,368 B1 * 9/2004 Vachon ..... E03F 7/10 15/340.1
2003/0085182 A1 * 5/2003 Wilkins ..... B01D 35/027 210/767
2008/0178943 A1 * 7/2008 Rashid ..... E03F 1/002 137/398
2012/0118820 A1 * 5/2012 Potts ..... E03F 1/002 210/620
2013/0306572 A1 * 11/2013 Potts ..... C02F 1/006 210/747.9
2014/0299541 A1 * 10/2014 Armour ..... C02F 3/00 210/631
2015/0041403 A1 * 2/2015 Potts ..... C02F 1/006 210/703
2016/0115059 A1 * 4/2016 Robertson ..... C02F 9/00 210/202

OTHER PUBLICATIONS

What to do when septic tank alarm goes off? Source https://www.proreferral.com/experts/question/what-to-do-when-septic-alarm-for-pump-goes-off.

* cited by examiner

*Primary Examiner* — Julie Lieu

(57) ABSTRACT

A system and method of detecting pending failure of a septic tank drain field in order to provide remediation to reduce or eliminate the sludge buildup prior to total failure and extend the life of the drain field comprising of a sensor, alarm system.

Specific action that can be taken to remediate a drain field include adding natural or engineered bacteria and/or other environmentally friendly additives that will attack the sludge and clear the way for the effluent water to drain and help to maintain a properly operating system.

17 Claims, 5 Drawing Sheets

DRAIN FIELD ALARM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD

The present application relates to alarms for drain fields.

BACKGROUND

Drain fields are used to dispose of water into the ground. In particular a septic tank drain field takes the relatively "solids" free water called, effluent from the septic tank and distributes it into the soil for final impurity and contaminate removal. The problem is that sludge can build up in the field and over time cause the field to fail. The buildup of sludge can take several years before the field fully fails. However, current methods of opening an inspection port and seeing if there is standing water in the inspection pipe/port only tell you that the field has failed, and do not provide an early warning system. Unfortunately, once a septic system drain field fails, there is little or no recourse but to replace the system at a cost that often exceeds $20K.

Therefore, there continues to be a need for a system of early detection of pending failure so that remediation can be performed to reduce or eliminate the sludge buildup prior to total failure and extend the life of the drain field.

SUMMARY

In order to overcome the deficiencies in the prior art, systems and methods are described herein.

One aspect of the claimed invention involves an alarm system connected to one or more sensors configured to detect early warning signs of pending failure of the drain field when placed in one or more drain field inspection ports.

Another aspect involves placing one or more sensors configured to detect early warning of potential drain field failure in one or more drain field inspection ports, connecting the one or more sensors to an alarm system, monitoring the alarm system for alerts, and taking action to remediate potential drain field failure.

These and other aspects described herein present in the claims result in features and/or can provide advantages over current technology.

The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages or features are mutually exclusive or contradictory, in that they cannot be simultaneously present in a single embodiment. Similarly, some advantages are applicable to one aspect of the invention, and inapplicable to others. Thus, the elaborated features and advantages should not be considered dispositive in determining equivalence. Additional features and advantages of the invention will become apparent in the following description, from the drawings, and from the claims.

DETAILED DESCRIPTION

The instant devices and approach provide a way to detect pending failure of a septic tank or other drain field in order to provide remediation to reduce or eliminate the sludge buildup prior to total failure and extend the life of the drain field.

Figure 1:
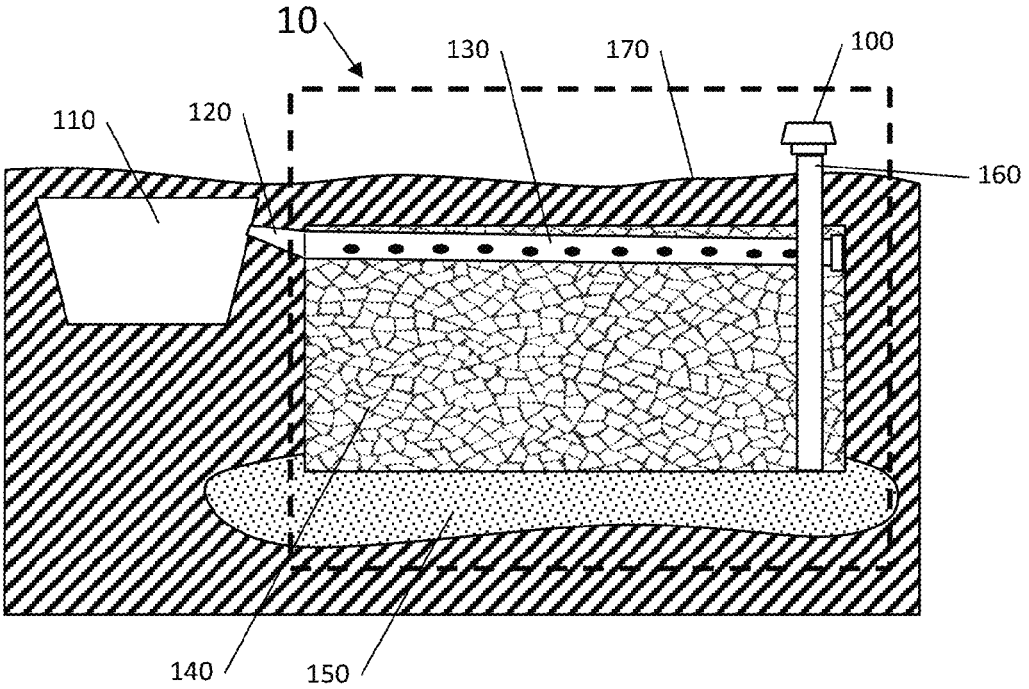
FIG. 1 shows, in simplified form, an underground septic drain field with an inspection port alarm.

FIG. 1 shows, in simplified form, an underground septic drain field 10 with an 100. Coming from a septic tank 110 is a directing pipe 120, which directs effluent into the drain field 10, which is typically comprised of perforated pipe 130 embedded with a layer of stone 140 on top of a layer of sand 150. Code typically requires that a septic tank drain field has inspection ports in all four corners of the drain field 160, which extend out of the ground 170 and all the way to the bottom of the stone layer 140, in close proximity to the sand layer. If there is standing water visible at the bottom of one or more of the inspection ports during a periodic inspection the drain field is assumed to have failed.

It is worth noting that in a properly operating drain field there should typically never be any water visible from the inspection port 160 during normal usage, the reason being that the field is typically built for a calculated maximum usage. However, as sludge begins to build up the ability of the effluent entering the drain field to drain into the sand layer 150 will be reduced and may produce temporary water within the inspection port that is only detectable if a human inspector looks at it in just the right time. However, water temporarily visible during maximum usage, e.g. you are throwing a party for 20 or so people, would never be considered a field failure as the water that will drain on its own once there is a return to normal usage. It is only when there ends up being standing water above the sand 150 during normal usage that the field has failed and an inspector doing an inspection might be able to detect it.

Additionally, it is worth noting that a temporary rise (or even a low sustained level) of effluent is not considered an immediate health/safety risk, as effluent will continue to be processed throughout the stone layer 140. It is the lack of a health/safety risk that is the reason the drain field is typically only ever inspected when ownership of the property is being transferred.

Figure 2:
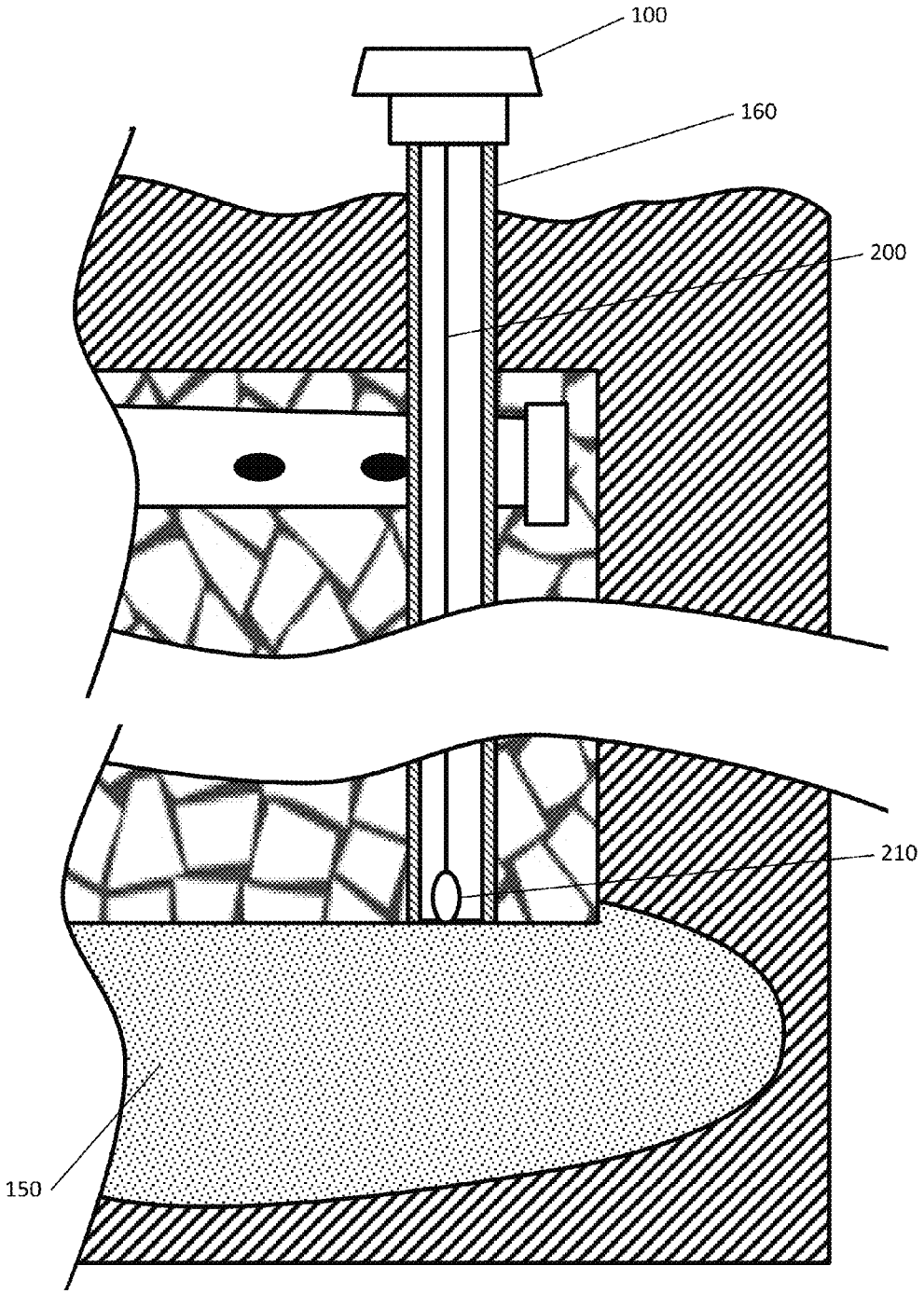
FIG. 2 shows, in simplified form, an expanded/cross section view of inspection port and additional components of the inspection port alarm.

FIG. 2 shows, in simplified form, an expanded/cross section view of inspection port 160 and additional components of the inspection port alarm 100.

The inspection port alarm 100 utilizes one or more connectors 200 to interface with one or more sensor elements 210. In its simplest form, the one or more connectors 200 could be a simple two lead wires and the one or more sensor elements 210 could simply be the two lead wires having exposed ends and having a gap between them such as air (or other non-conducting materials) and then forming a closed circuit when effluent makes an electrical connection between them and placed in close proximity to the bottom of the inspection port 160. An enhancement, of the alarm system just described is to have multiple wire leads placed at fixed increment heights above the layer of sand 150 such that the depth of the effluent can be measured. A further refinement might be to place one of the exposed leads in one inspection port and another one of the leads in another to measure conductivity between them.

While placing the one or more sensor elements 210 in close proximity to the bottom of the inspection port (e.g. at the sand 150 or within a couple of inches of it), in some situations, particularly when maximum usage occurs frequently it might be desirable to place the one or more sensors at a predetermined distance above the bottom of the inspection port. Predetermined distances might be a percentage of the stone height, for example 5, 10, 15, 20, 25, 30, 35, 40, 45, 50, 75, or 100%, or based upon the same percentages but based on the calculated maximum load level.

Other anticipated sensor elements 210 include float sensors, humidity sensors, temperature sensors (if the temperature is increasing it could be an indication of one or more of increased biomass or a slow draining field since the temperature of the effluent is typically much higher than the surrounding field, which depending on the depth of the surrounding field is typically at a constant temperature year round as code typically requires the field to be below the frost line), a bacteria counter, or an electronic nose, which is a sensor for detecting specific odors and chemicals present in the air related to the buildup of sludge (e.g. ammonia/bleach or household paints are just a few of the substances which can kill off the sludge eating bacteria in a drain field and once killed off the sludge can build up quickly). Again, a refinement could be to place one or more sensor (or components of the sensor) in at least two inspection ports such that differences can be measured between them.

The one or more connector element 200 need not necessarily be a physical connection, although a physical connection is highly desirable for sensor retrieval, forms of non-physical connection include Bluetooth, Wi-Fi, radio and telephonic transmission. The point being not the particular type of connector utilized but that information from the one or more sensor elements 210 is transmitted to the alarm.

Figure 3:
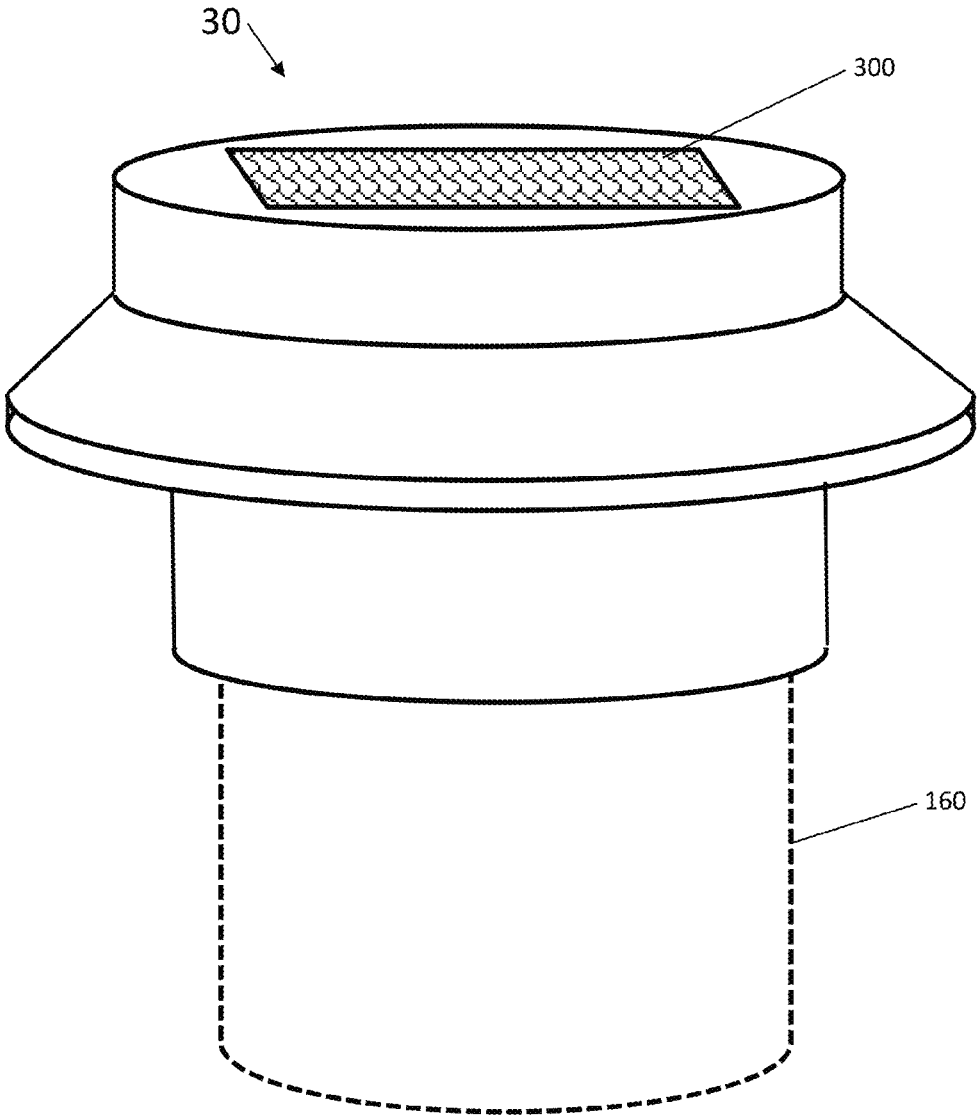
FIG. 3 shows in simplified form, a representative inspection port alarm.

FIG. 3 shows in simplified form, a representative inspection port alarm 30. The alarm 30 is shown as matingly connected for example sitting over the top of the inspection port 160, which is often an ideal location. The alarm 30 is represented as configured to fit on the top of a typical 4" diameter inspection port 160, or whatever diameter pipe utilized. In this configuration, the alarm 30 would typically be battery powered or have a solar panel 300 on top of the alarm. In other embodiments, it could have electrical power running to it or acquire power by harnessing the energy related to the temperature differential between the bottom (near the sand layer 150) of the inspection port 160 and the top.

Other anticipated versions include nesting inside the inspection port or provide a mechanical compression fit inside of the inspection port rather than nesting over or compressing onto the outside of the inspection port.

The alerts issued to an end user by the alarms in the embodiments discussed can range from a simple visual or auditory warning when electrical connection is made between the previously mentioned lead wires to more sophisticated systems that track changes over time and use pattern recognition to predict failures. However, it is worth noting that the alarm system need not necessarily be on top of the inspection port, especially when the one or more connectors 200 are nonphysical and, as such, the alarm system could be part of a mobile app or information that is sent back to a central station for processing and analysis.

While the alarm system of the embodiments described above will provide an early warning of pending failure that may occur 2-3 years hence. The value of the early warning it the ability that it gives a user to take remedial action. As such, exemplary methods of use will now be described.

Figure 4:
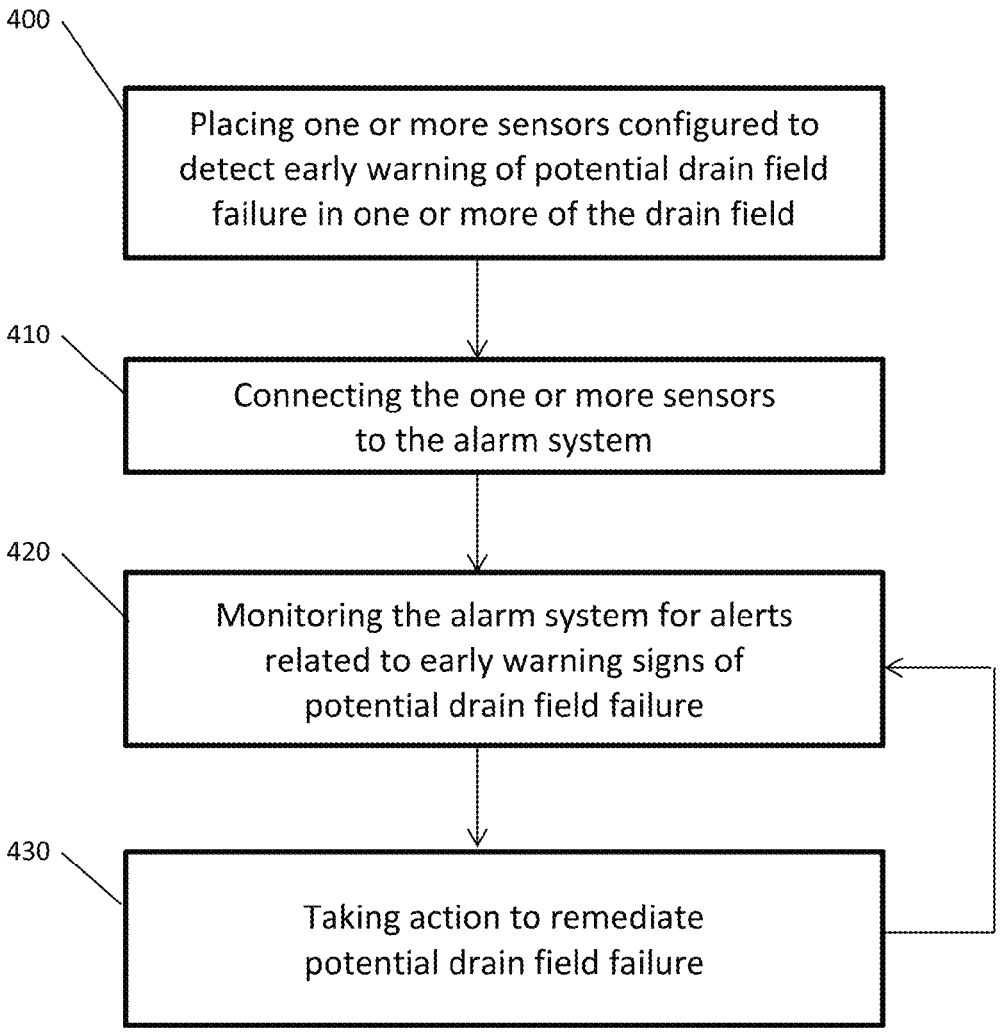
FIG. 4. Shows, in simplified form, an exemplary use of the of an inspection port alarm.

FIG. 4. shows, in simplified form, an exemplary use of the inspection port alarm. The method of using an inspection port alarm to detect early warning of potential drain field failure comprises: Placing one or more sensors configured to detect early warning of potential drain field failure in one or more of the drain field inspection ports [Step 400], connecting the one or more sensors to the alarm system [Step 410], Monitoring the alarm system for alerts related to early warning signs of potential drain field failure [Step 420], and Taking action to remediate potential drain field failure [Step 430]. Optionally, after remedial action has been taken [Step 430], returning to monitoring the alarm system [Step 420] to either monitor the success of the remedial action or to look for further degradation of the drain field indicative of potential drain field failure.

Specific action that can be taken to remediate a drain field include adding natural or engineered bacteria and/or other environmentally friendly additives that will attack the sludge and clear the way for the effluent water to drain and help to maintain a properly operating system.

Figure 5:
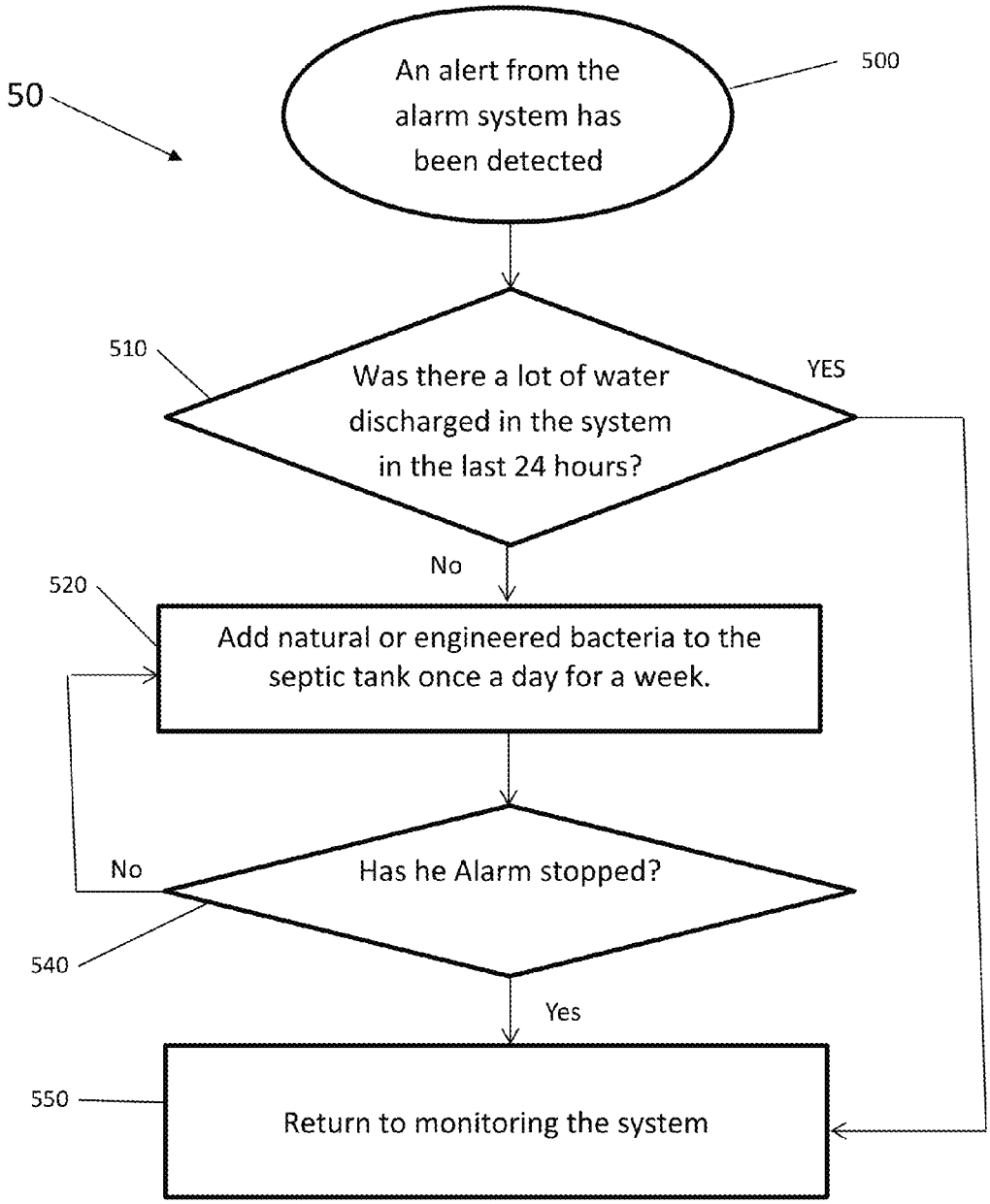
FIG. 5 shows, in simplified form, a representative remediation decision tree.

FIG. 5 shows, in simplified form, a representative remediation decision tree 50. The remediation decision tree 50 begins when an alert from the alarm system has been detected [Step 500]. The next step would typically be to determine whether there was a lot of water discharged in the system in the last 24 hours? [Decision 510]. If there was a lot of discharge then no remediation is likely necessary and the user should return to monitoring the system for alerts [Step 550].

If there was not a lot of water flow in the last 24 hours then remediation is necessary and the user might be instructed to add natural or engineered bacteria to the septic tank once a day for a week [Step 530].

If after one week the alarm has stopped [Decision 540] then the user the user should return to monitoring the system for alerts [Step 550]. On the other, if the alarms are still present the user the user might be instructed to return to adding natural or engineered bacteria to the septic tank once a day for a week [Step 530].

Other anticipated applications include seepage pits, which have a vertical rather than a horizontal layout and rely on their depth to disperse the effluent. Seepage pits and are typically surrounded by rocks so that the waste water can percolate into the ground along their depth. Failure of a seepage pit can be particularly catastrophic because the effluent will flow back into the house.

However, with respect to seepage pits it is more typical to have temporary water in the bottom of the pit and therefor instead of placing the sensor in close proximity to the bottom of the pit, it would be more typical to place the sensor at predetermined distances above the bottom of the pit, which might be a percentage of the stone height, for example 5, 10, 15, 20, 25, 30, 35, 40, 45, 50, 75, or 100%, or based upon the same percentages but based on the calculated maximum load level.

Finally, it is to be understood that various different variants of the invention, including representative embodiments and extensions have been presented to assist in understanding the invention. It should be understood that such implementations are not to be considered limitations on either the invention or equivalents except to the extent they are expressly in the claims. It should therefore be understood that, for the convenience of the reader, the above description has only focused on a representative sample of all possible embodiments, a sample that teaches the principles of the invention. The description has not attempted to exhaustively enumerate all possible permutations, combinations or variations of the invention, since others will necessarily arise out of combining aspects of different variants described herein to form new variants, through the use of particular hardware or software, or through specific types of applications in which the invention can be used. That alternate embodiments may not have been presented for a specific portion of the description, or that further undescribed alternate or variant embodiments may be available for a portion of the invention, is not to be considered a disclaimer of those alternate or variant embodiments to the extent they also incorporate the minimum essential aspects of the invention, as claimed in the appended claims, or an equivalent thereof.

What is claimed:

1. A drain field alarm system comprising:

one or more sensors configured to detect early warning signs of pending failure of the drain field when placed in one or more inspection ports associated with the drain field;

an alarm configured to issue alerts to an end user based upon information received from the one or more sensors; and an interface configured to transmit information between the alarm and the sensor, wherein the sensor is one or more of an electronic nose or a bacteria counter.

2. The system of claim 1 wherein the sensor is configured to be placed in close proximity to the bottom of the one or more inspection ports and configure to make an electrical connection when effluent is present at the sensor.

3. The system of claim 2 wherein the sensor is configured to detect the depth of the effluent.

4. The system of claim 1 wherein the electronic nose is configured to detect ammonia.

5. The system of claim 1 wherein the electronic nose is configured to detect paint.

6. The system of claim 1 wherein in the alarm is configured to matingly connect with one or more inspection ports.

7. The system of claim 6 wherein the alarm is matingly connected by sitting over the top of the one or more inspection ports.

8. The system of claim 7 wherein the alarm is solar powered.

9. A drain field remediation method comprising:

placing one or more sensors configured to detect early warning of potential drain field failure in one or more of inspection ports associated with the drain field;

connecting the one or more sensors to an alarm system;

monitoring the alarm system for alerts related to early warning signs of potential drain field failure;

taking action to remediate potential drain field failure; and wherein the method further comprises one or more of the following:

adding bacteria as component of the taking action to remediate, re-monitoring the alarm system for alerts related to early warning signs of potential drain field failure after the taking action to remediate, or the placing is done in two or more of inspection ports and the monitoring is done by measuring differences between inspection ports.

10. The method of claim 9 wherein connecting is done through a physical connection.

11. The method of claim 9 wherein connecting is done through a non-physical connection.

12. The method of claim 9 wherein the bacteria is an engineered bacteria.

13. The method of claim 9 wherein the early warning of potential drain field failure is related to the depth of effluent in the one or more inspection ports.

14. The method of claim 9 wherein the one or more sensors is an electronic nose.

15. The method of claim 9 wherein the one or more sensors is a bacteria counter.

16. The method of claim 9 further comprising mating the alarm with one or more of inspection ports.

17. A drain field alarm system comprising:

two or more sensors configured to detect early warning signs of pending failure of the drain field when placed in two or more inspection ports associated with the drain field;

an alarm configured to issue alerts to an end user based upon measuring differences between inspection ports using information received from the two or more sensors; and an interface configured to transmit information between the alarm and the two or more sensors.

* * * * *